US010004346B2

(12) United States Patent
Keys

(10) Patent No.: US 10,004,346 B2
(45) Date of Patent: Jun. 26, 2018

(54) DRINKING VESSEL MONITOR

(71) Applicant: Hugo Keys, Salt Spring Island (CA)

(72) Inventor: Hugo Keys, Salt Spring Island (CA)

( * ) Notice: Subject to any disclaimer, the term of this patent is extended or adjusted under 35 U.S.C. 154(b) by 240 days.

(21) Appl. No.: 15/076,382

(22) Filed: Mar. 21, 2016

(65) Prior Publication Data

US 2017/0265664 A1 Sep. 21, 2017

(51) Int. Cl.

| | |
|---|---|
| ***A47G 19/22*** | (2006.01) |
| ***B65D 55/14*** | (2006.01) |
| ***B65D 55/02*** | (2006.01) |
| ***B65D 43/02*** | (2006.01) |

(52) U.S. Cl.

CPC ..... *A47G 19/2227* (2013.01); *B65D 43/0235* (2013.01); *B65D 55/028* (2013.01); *A47G 2019/2238* (2013.01); *A47G 2019/2244* (2013.01); *A47G 2400/123* (2013.01); *B65D 55/14* (2013.01)

(58) Field of Classification Search

CPC ..... A47G 19/2227; A47G 2019/2238; B65D 43/0235; B65D 55/00; B65D 55/028; B65D 55/04; B65D 55/14

See application file for complete search history.

(56) References Cited

U.S. PATENT DOCUMENTS

| | | | | |
|---|---|---|---|---|
| 8,613,417 | B2 * | 12/2013 | Kraus, Jr. | A47G 23/03 248/346.11 |
| 2008/0302794 | A1 * | 12/2008 | Wagner | B65D 55/145 220/210 |
| 2014/0305940 | A1 * | 10/2014 | Schmidt | B65D 50/00 220/212 |
| 2014/0374301 | A1 * | 12/2014 | West | G09F 11/04 206/459.5 |

FOREIGN PATENT DOCUMENTS

| | | | | |
|---|---|---|---|---|
| DE | 102013103579 | A1 * | 12/2013 | B65D 55/14 |

* cited by examiner

*Primary Examiner* — Christopeher R Harmon

(57) ABSTRACT

A drinking vessel monitor in the form of a lid with a protective disc of rigid material and a depending skirt. A key operated mechanical linkage is connected to contact members underlying the protective disc. Springs cause the contact members to pivot outwardly upon removal of the lid from a drinking vessel. Without the key to operate the mechanical linkage, the contact members hidden within the skirt cannot be retracted sufficiently to place the lid back on the drinking vessel. Optionally, an electrical circuit can be added with a signal generator which generates a visual or audible signal if tampering has occurred.

3 Claims, 6 Drawing Sheets

DRINKING VESSEL MONITOR

FIELD

There is described a drinking vessel monitor which enables a user to determine whether their drinking vessel has been tampered with during their absence.

BACKGROUND

Patrons who frequent public establishments, such as bars, lounges, or restaurants, will occasionally find themselves in a situation where they are required to leave their drinks unattended from time to time. This may be for reasons such as going to the washroom or moving to the dance floor. Regardless of the reason, an unattended drink is exposed to the possibility of being contaminated by someone introducing a deleterious substance to the drink such as a "date rape" drug.

There are several products on the market that attempt to address this problem. They fall into two basic categories: One is in the form of a vessel having a lid designed to fit specifically onto it and lock into place. The second category involves the placement of a barrier which either adheres to, or snaps over the rim of the opening. U.S. Pat. No. 8,613,417 B2 discloses a combination coaster with detachable cover that sticks to the opening rim of a glass. U.S. Pat. No. 7,979,973 B2 discloses a frame with a thin film across it which can be lowered over the opening of a container and sealing the opening. US Pub. US2013 0082067 A1 discloses an elastic rubber lid which is stretched over the rim of a drinking glass.

SUMMARY

There is provided a drinking vessel monitor which includes a lid comprised of a protective disc of rigid material with a depending skirt. The disc has an upper surface and a lower surface. The skirt has an interior surface and an exterior surface. Contact members are pivotally mounted to the lower surface of the disc. One or more springs bias the contact members outwardly into contact with the interior surface of the skirt. A mechanical linkage is connected to the contact members. The mechanical linkage permits the contact members to be retracted inwardly sufficient for the lid to be placed on a drinking vessel with an upper edge of the drinking vessel interposed between the contact members and the interior surface of the skirt. The mechanical linkage is operable with a key. The one or more biasing springs cause the contact members to pivot outwardly upon removal of the lid from the drinking vessel. Without the key which operates the mechanical linkage, the contact members hidden within the skirt cannot be retracted sufficient to place the lid back on the drinking vessel.

In use, the lid portion of the device is placed over the opening of a drink vessel, such as a glass, that is to be protected. Turning the key clockwise causes the contact members the freedom to pivot outward by spring action towards the inside rim of the glass. The key is then removed leaving the outermost ends of the contact members arms resting against the inside rim of the drinking vessel opening. If the device is subsequently lifted the slightest amount, one or more of the arms will slip over the rim of the drinking vessel. Without the key, it is very difficult to reset the system by manipulating the arms back within the inside rim of the glass due to the depending skirt and the configuration of the contact members, therefore, when the patron returns to the drink, it will be obvious to him or her that the drink opening has been exposed and therefore, possibly contaminated.

As will hereinafter be further described, the drinking vessel monitor described above can be equipped with an alarm system to provide further warning by adding contact points on the interior surface of the skirt which are part of an electrical circuit. The contact members can also be made part of the electrical circuit. When the contact members contact the contact points on the interior surface of the skirt, the electrical circuit is closed. A signal generator can be included as part of the electrical circuit to generate a visible, audible or other signal when the electrical circuit is closed.

It is anticipated that the lid will be made from a rigid plastic or other suitable substance and with a diameter of sufficient size to cover and envelope the openings of a wide range of commonly used drinking vessels. The mechanical linkage that is operable with the key, will hereinafter be described in more detail.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

A drinking vessel monitor will now be described with reference to FIG. 1 through FIG. 11.

Structure and Relationship of Parts:

It is contemplated that all components of the embodiment are to be constructed from rigid plastic or some other suitable material except for the components in the electrical circuitry which are constructed from suitable electrically conductive materials.

Figure 1:
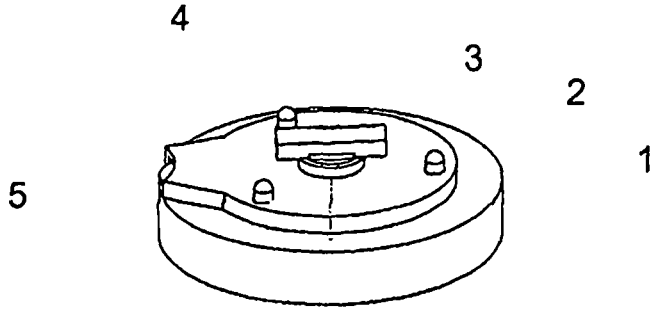
FIG. 1 is a perspective view of the invention from above.

With reference to the drawings, FIG. 1 shows a perspective view of the embodiment from above revealing a rigid disk and descending perimeter skirt combination 1. This combination disc and skirt is intended to envelope the opening of a drinking vessel. On the upper surface of the disc is a permanently attached upper cover 4, which contains holes in it to allow LED lights 2 to protrude through. An electronic buzzer or alarm may be substituted for one of these lights. Also shown is a key 3 and a battery 5.

Figure 2:
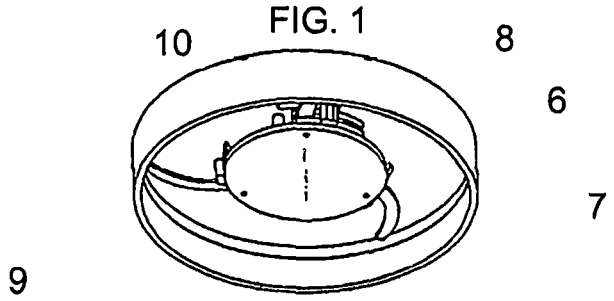
FIG. 2 is a perspective view of the invention from below.

FIG. 2 is a perspective view from below showing electrically conductive contact members 7 in an extended position with their outermost tips contacting an electrically conductive perimeter strip 9. When any one of these contact members make contact with this strip, an electrical circuit is closed and energizes warning lights and/or aural alarms. Also shown is one of three curved slots 10 which are located around the centre of the upper disc and through which retaining posts 8 descend.

Figure 3:
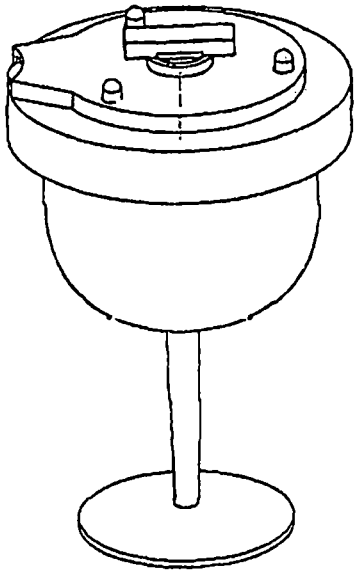
FIG. 3 is a view of the invention as it would appear when in use covering the opening of a drinking glass.

FIG. 3 shows the invention as it would appear in use covering the opening of a drink glass. The key 3 is removed after the device is armed.

Figure 4:
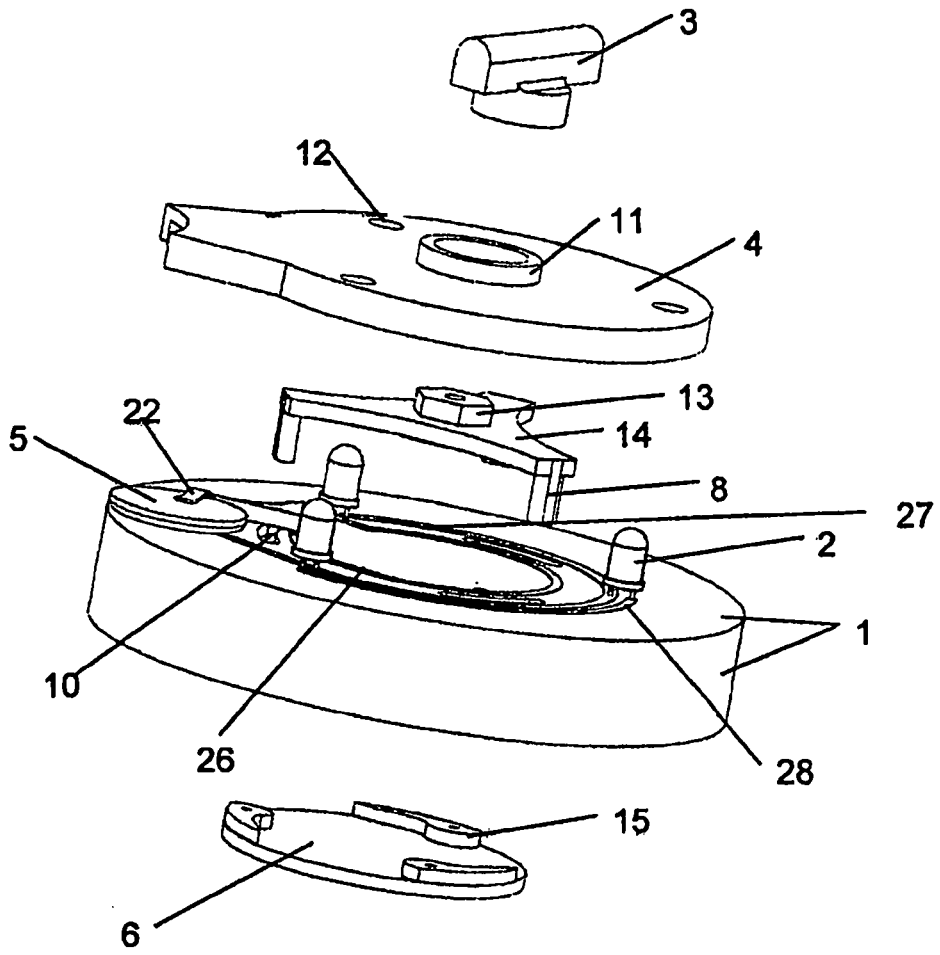
FIG. 4 is an exploded view showing the components of the invention from above.

FIG. 4 shows an exploded view from above. The key 3 is shown at the top. Below this is the top cover 4 containing holes 12 which allow the LED lights 2 to protrude through. Also shown is a collar 11 which is permanently attached to the top cover, and surrounds a male component 13 of a lock mechanism. The purpose of the collar is to make it difficult to access and manipulate the lock mechanism with anything other than the matching key. Below the top cover 4 is a body 14 (depicted in this embodiment as triangular in shape) on top of which is attached the male component 13 of the lock mechanism as well as the descending posts 8. These posts protrude through arc shaped slots 10 in the main disc 1 and depending upon which direction the lock mechanism is rotated, these posts either stow or release the contact members 7 attached to the underside of the main covering disc and skirt 1. Also shown are LED lights 2 which are attached to electrical circuitry on the main disc and skirt 1. The circuitry observable in this view is comprised of a contact for the battery positive terminal 22, which leads through a switch to the positive side of a circuit 26, a battery negative circuit 27 and a secondary battery positive circuit 28. The latter being energized when a contact member 7 contacts the perimeter strip 9 on the inside of the skirt. At the bottom of the drawing is a lower cover 6 with spacers 15.

Figure 5:
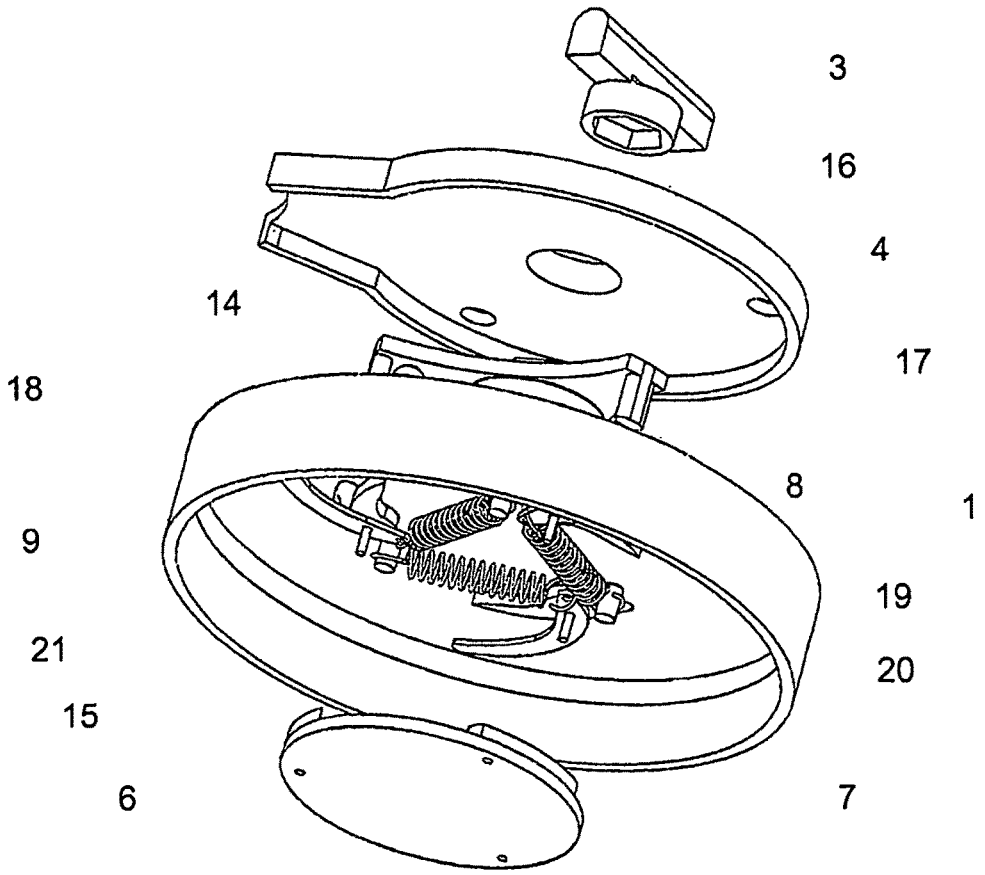
FIG. 5 is an exploded view showing the components of the invention from below.

FIG. 5 shows an exploded view from below. The key 3 at the top displays the female component 16 of the lock mechanism which in this embodiment is hexagonal in shape. The shape displayed in this depiction is for example only and it is intended that various shapes of different sizes be employed so as to ensure a wide range of key/lock combinations. Next, the underside of the top cover 4 is shown. Below that is the triangular body 14 with attached descending posts 8 and a lower spacer 17. The main covering disc and skirt 1 are shown with the conductive perimeter strip 9. There are upper spacers 18 attached to the lower surface of the main disc 1, and these align with the lower spacers 15 to limit vertical displacement of the contact members. Actuator springs 19 have one end attached to anchor posts 20 affixed to the bottom surface of the main disc 1. The other end of each spring is attached to the end of each of the contact members 7. The anchor posts 20 also serve as attachment points to the lower cover 6. Also shown are three electrically conductive pins 21 around which the contact members 7 rotate.

Figure 6:
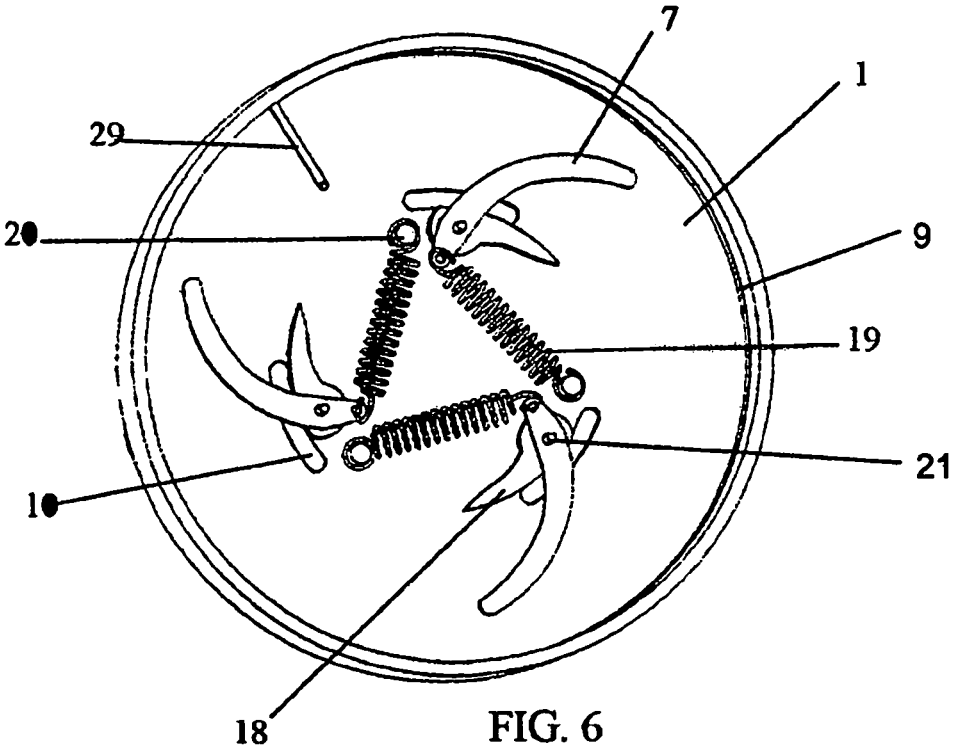
FIG. 6 shows the contact member mechanism in a partially extended position.

FIG. 6 shows the underside of the embodiment with the lower cover 6 removed. The configuration of the springs 19 and contact members 7 are displayed with the contact members in a midway position between stowed and fully extended. Also shown are the upper spacers 18, the curved slots 10, and an electrical connector 29 which connects the conductive perimeter strip 9 to the battery secondary positive circuit 28 which is on the top of the covering disc.

Figure 7:
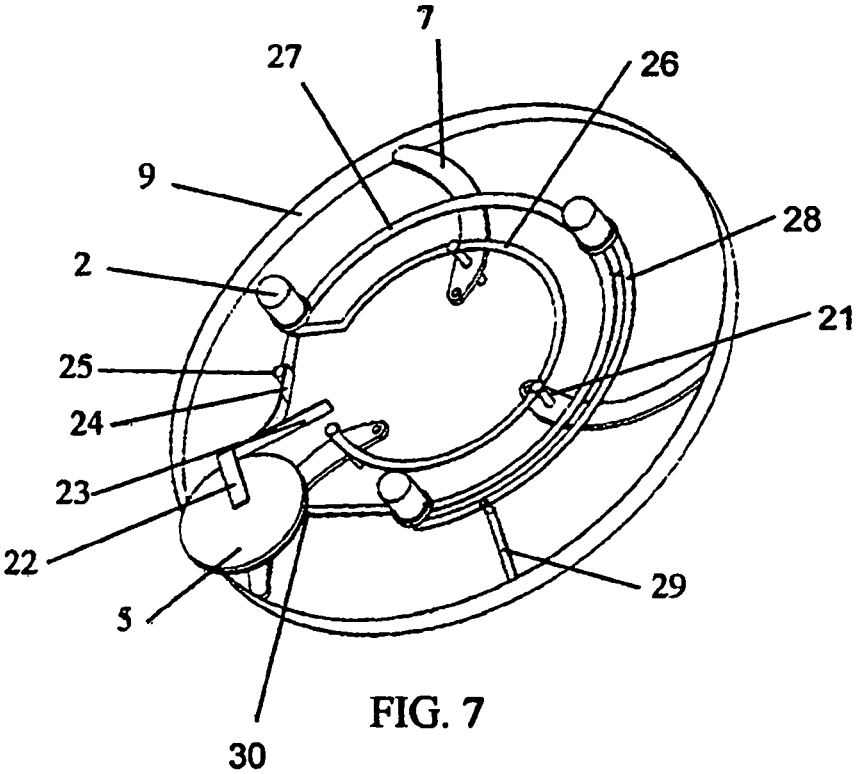
FIG. 7 shows all components of the electrical circuitry.

FIG. 7 is an illustration of the electrical circuitry. The positive side starts with the battery 5 and the circuit runs through a battery positive contact 22 to a switch shown in an open position 23 and a closed position 24. The switch is actioned by using the key 3 to rotate the triangular body 14, clockwise to its mechanical limit making contact with a post 25. From there, the circuit continues around a loop of conductive material 26. Attached to this loop, are conductive pins 21 and the contact members 7. When one or more contact members 7 swing out and make contact with the conductive strip 9 the positive circuit continues around strip 9, through the connector 29 and then to a secondary battery positive strip 28. The negative circuitry is depicted as loop 27 starting at the battery negative terminal 30 and continuing around to terminate at the LED 2 negative post. All LEDs are connected in parallel between the positive and negative circuits. It is intended that an electronic buzzer/alarm could replace one of the LEDs.

Figure 8:
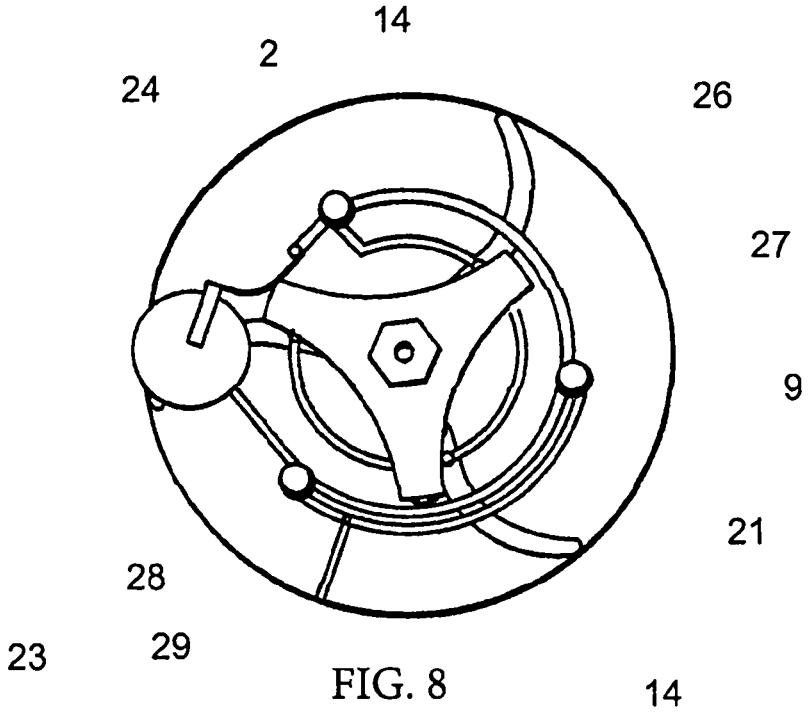
FIG. 8 shows the switch in the closed position.

FIG. 8 depicts the circuit in the closed position showing how the triangular body 14 actuates it.

Figure 9:
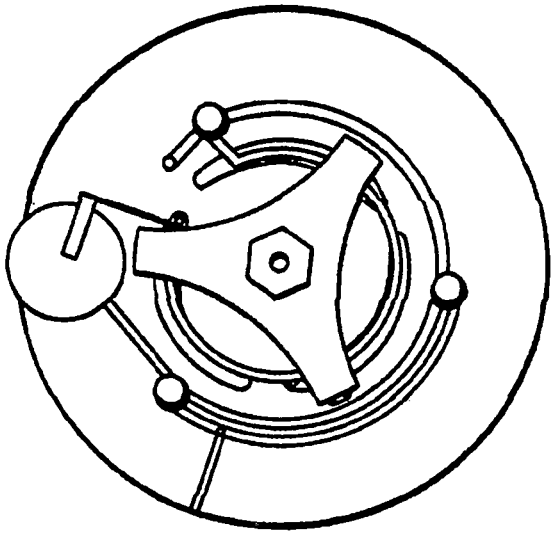
FIG. 9 shows the switch in the open position.

FIG. 9 depicts the circuit in the open position with the associated position of triangular body 14.

Figure 10:
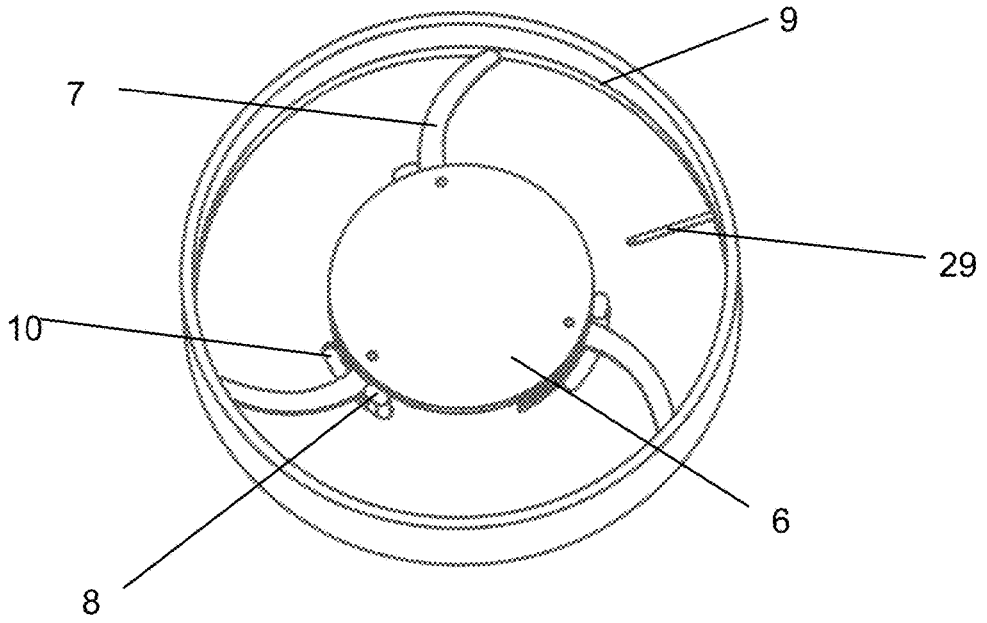
FIG. 10 is a view from below showing the contact members in the extended position.

FIG. 10 shows the contact members 7 fully extended touching the conductive strip 9. It also shows the position of the descending posts 8 at the furthest extent of their travel within the curved slots 10. This is the "ARMED" position when the key is turned to the fully clockwise limit.

Figure 11:
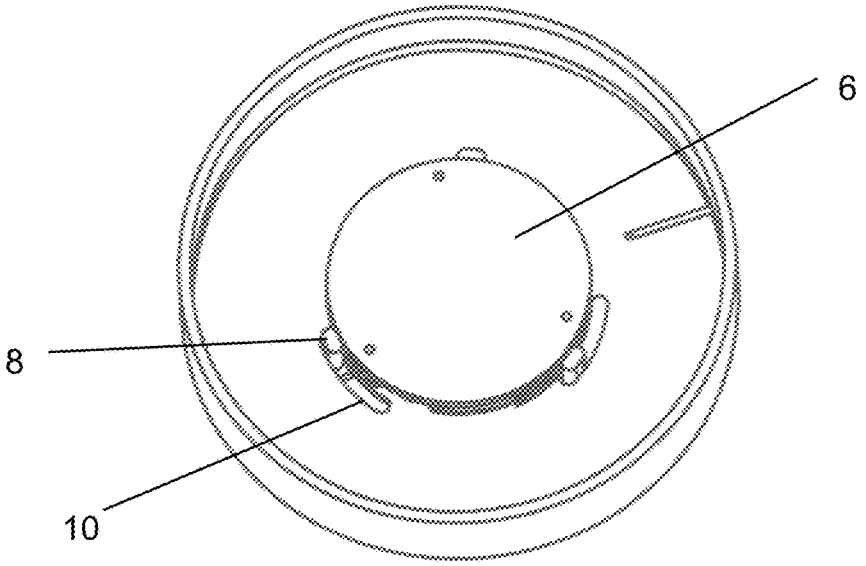
FIG. 11 is a view from below showing the contact members in the retracted (stowed) position.

FIG. 11 shows the underside of the device when the key is turned to the fully anticlockwise position. The descending posts 8 are at the limit of their travel within the curved slots 10 and have forced the contact members to be stowed. This is the "OFF" position.

The embodiment is intended to provide indication as to whether a drink has had its contents exposed to possible contamination by someone adding a deleterious substance to it. If a drink is to be left unattended, the device, in the "OFF" configuration, as shown in FIG. 11, is placed over the opening of the drinking vessel so as to cover and enclose it as shown in FIG. 3. In this configuration, the key 3 is at its anticlockwise (as viewed from above) mechanical stop position. This position is determined by the retaining posts 8 being at their maximum anticlockwise travel within the curved slots 10 through which they protrude. This is illustrated in FIG. 11. In this position, the contact members 7 are stowed within the perimeter of the bottom cover 6 by the retaining posts 8 which are connected to the key through the triangular body 14 with its attached male component of the lock mechanism 13. Also, in the "OFF" position, the battery switch is in the open position 23 as illustrated in FIG. 9. The key 3 is then turned clockwise to its mechanical stop "ARMED" position, as determined by the retaining posts 8 being at their maximum clockwise travel within the curved slots 10 as shown in FIG. 10. In this position, the contact members 7 are now free to swing outward. The upper spacers 18 which are attached to the lower surface of the main disc 1 cause the vertical position of the arms to be slightly below the lower surface of the main disc 1 which is resting on the rim of the drinking vessel opening. Because of this displacement, the contact members 7 will swing outward and come to rest against the inside of the rim of the drinking vessel. Also, in the "ARMED" position, the switch 24 is forced to the closed position by the triangular body 14 as illustrated in FIG. 8. This allows the current to flow from the battery, through the switch and to the battery positive loop 26 providing energy to the positive post of the first LED 2 in the circuit. The negative post of this LED is connected to the battery negative loop 27 so the LED illuminates thus serving as a battery test and a warning that the device is armed. With the battery positive loop now energized, the contact members 7 are also energized through their connection through the electrically conductive pivoting pins 21.

If the device is lifted even slightly while in the "ARMED" state, one or more of the contact members 7 will slip over the restraining lip of the drinking vessel, and will make contact with the electrically conductive strip 9. When this happens, the electrical circuit is closed, connecting the battery positive loop via the contact members, around the inner perimeter strip 9, through the connector 29, to the secondary battery positive circuit 28. The remaining LEDs are now illuminated, therefore, when the patron returns to the drink, it will be obvious that the drink opening has been exposed.

The depending skirt and the configuration of the contact members make it very difficult to manipulate them back inside the rim of the drinking vessel to reset the system, and attempting to do so in a bar or restaurant type environment would almost certainly attract attention. Also, because the device is constructed of a rigid material, it would not be possible to contaminate the drink using a syringe to penetrate it, therefore, if the device is still armed when the patron returns to it, he or she can be reasonably confident that the drink has not been contaminated.

The reader shall see from this description that the embodiment provides a more reliable method to ascertain whether an unattended drink has possibly been exposed to contamination.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A drinking vessel monitor, comprising:

a lid comprised of a protective disc of rigid material with a depending skirt, the disc having an upper surface and a lower surface, the skirt having an interior surface and an exterior surface;

contact members pivotally mounted to the lower surface of the disc;

one or more springs biasing the contact members outwardly into contact with the interior surface of the skirt;

a mechanical linkage connected to the contact members, the mechanical linkage when rotated in one direction causes the contact members to be retracted inwardly so that the lid may be placed on a drinking vessel with the upper edge of the drinking vessel interposed between the contact members and the interior surface of the skirt, and, when the mechanical linkage is rotated in the opposite direction, the contact members are released so as to pivot outwardly under the pressure of the biasing springs until such movement is constrained by the interior surface of the drinking vessel, if the lid is removed or lifted from the drinking vessel the contact members continue to move outwardly until they are constrained by the interior surface of the skirt;

a key is employed to operate the mechanical linkage.

2. The drinking vessel monitor of claim 1, wherein contact points are positioned on the interior surface of the skirt, the contact points being part of an electrical circuit;

the contact members are part of the electrical circuit, when the contact members contact the contact points on the interior surface of the skirt the electrical circuit is closed; and a signal generator forms part of the electrical circuit and generates a signal when the electrical circuit is closed.

3. The drinking vessel monitor of claim 2, wherein turning the key in one direction closes a switch to energize the electrical circuit and illuminates a light to confirm that the electrical circuit is receiving power from a battery and is "armed" ready for use.

* * * * *